United States Patent [19]

Fast

[11] Patent Number: 4,671,002

[45] Date of Patent: Jun. 9, 1987

[54] PRODUCT IDENTIFICATION TAG WITH IMPROVED MOUNTING PORTION

[76] Inventor: Jacob J. Fast, 7561 NW. 9th St., Plantation, Fla. 33317

[21] Appl. No.: 719,164

[22] Filed: Apr. 2, 1985

Related U.S. Application Data

[63] Continuation-in-part of Ser. No. 519,226, Aug. 2, 1983, Pat. No. 4,525,944, which is a continuation-in-part of Ser. No. 473,650, Mar. 9, 1983, Pat. No. 4,531,313.

[51] Int. Cl.[4] ..... A44C 3/00

[52] U.S. Cl. ..... 40/2 R; 40/20 R; 40/584; 40/10 R

[58] Field of Search ..... 40/2, 20, 11 R, 584, 40/10, 20, 2 R, 11

[56] References Cited

U.S. PATENT DOCUMENTS

| | | | |
|---|---|---|---|
| 1,005,894 | 4/1911 | Senseman | 10/2 X |
| 2,199,968 | 4/1940 | Flood | 40/10 R |
| 2,564,293 | 8/1951 | Ammon | 40/10 X |
| 2,800,732 | 7/1957 | Duran | 40/11 R |
| 3,324,585 | 6/1967 | Frederickson | 40/11 R |
| 3,552,702 | 1/1971 | Springer | 40/11 R |
| 3,706,150 | 12/1972 | Greenberger | 40/124.1 |
| 3,977,109 | 8/1976 | Berry, Jr. et al. | 40/124.1 |
| 4,463,510 | 8/1984 | Windish | 40/2 R |
| 4,525,944 | 7/1985 | Fast | 40/584 |

FOREIGN PATENT DOCUMENTS

| | | | |
|---|---|---|---|
| 884536 | 3/1961 | United Kingdom | 40/124.1 |

*Primary Examiner*—Gene Mancene
*Assistant Examiner*—Wenceslao J. Contreras
*Attorney, Agent, or Firm*—Holman & Stern

[57] ABSTRACT

An elongate product identification tag for displaying merchandise data forwardly of a horizontally extending hook on which the merchandise is suspended, has a mounting portion of specialized form for use in securing the tag in a channel on a support panel to which the hook is attached via a bracket with an upper portion in the form of an inverted U which fits over the forward web of the channel. The mounting portion of the tag is shaped as a wedge for fitting in the channel behind the bracket portion and has a projection in a forward surface thereof against which a lower edge of the bracket engages to stabilize the tag in the channel and prevent its withdrawal until the hook is removed.

5 Claims, 6 Drawing Figures

FIG. 5
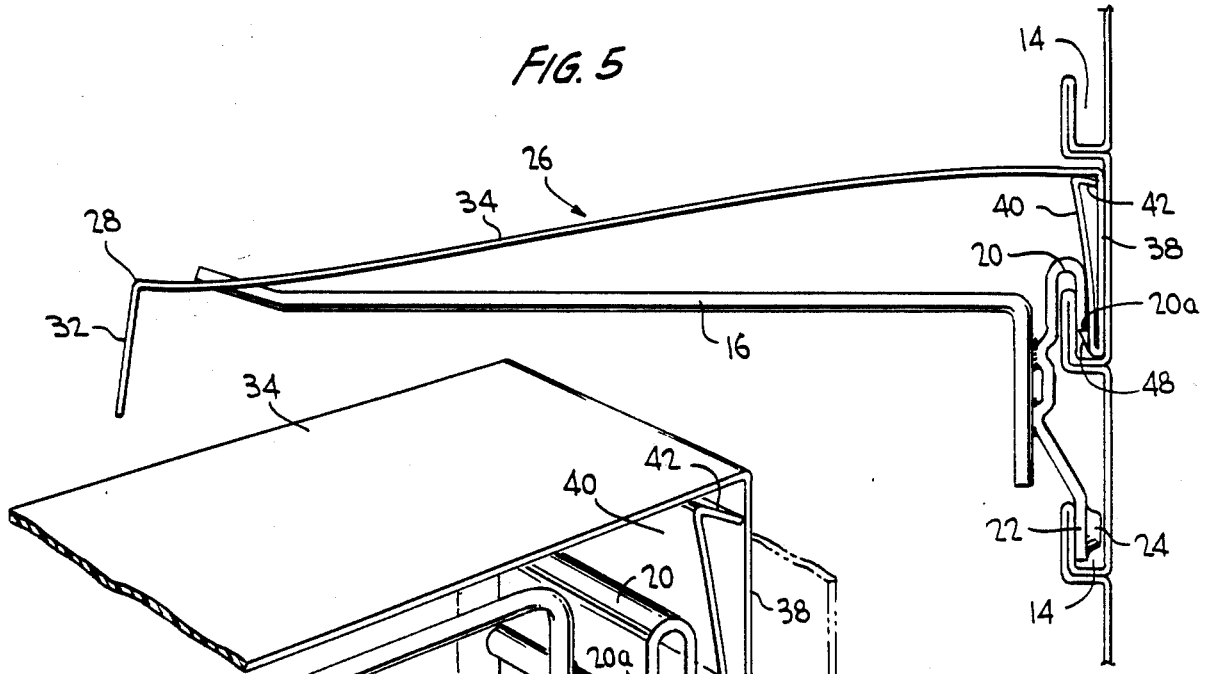
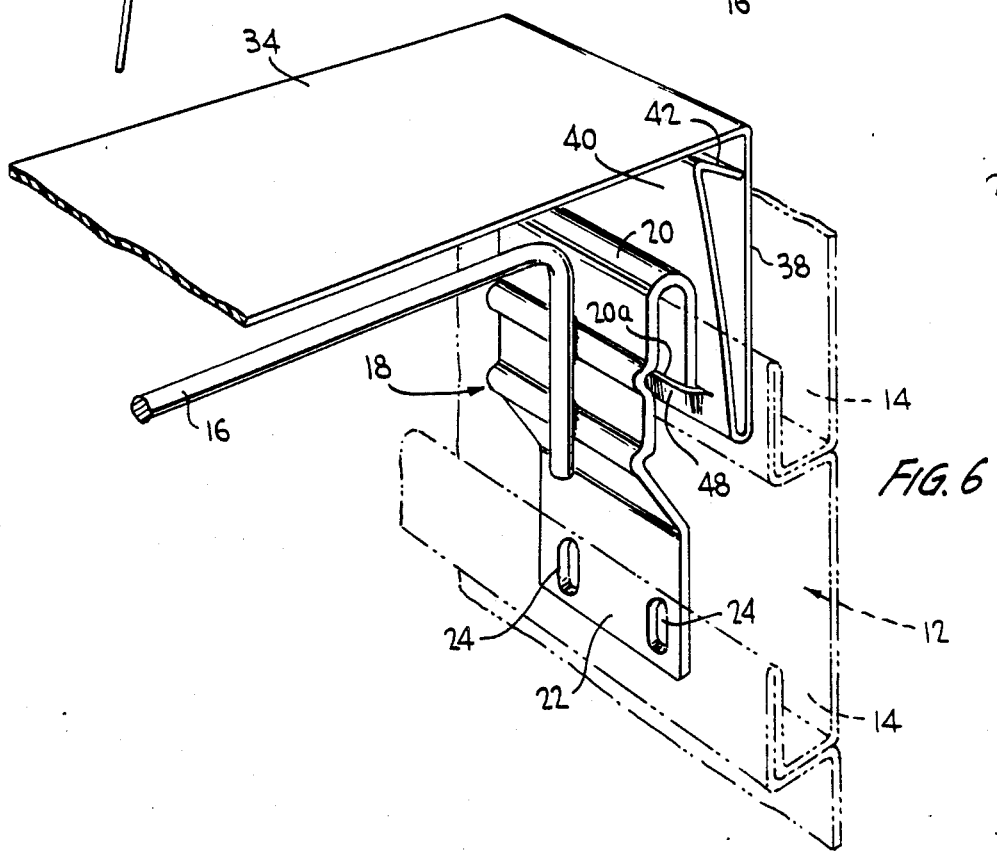
FIG. 6

PRODUCT IDENTIFICATION TAG WITH IMPROVED MOUNTING PORTION

CROSS REFERENCE TO RELATED APPLICATIONS

This application is a continuation-in-part of application Ser. No. 06/519,226, filed Aug. 2, 1983 for "Improved Product Indentification Tag" now U.S. Pat. No. 4,525,944 which is itself a continuation-in-part of application Ser. No. 06/473,650, now U.S. Pat. No. 4,531,313 filed Mar. 9, 1983 for "Merchandise Information Tag with Improved Mounting Arrangement". The disclosures of both of the above applications are expressly incorporated herein by reference.

BACKGROUND OF THE INVENTION

The inention relates to product identification and information tags for merchandise suspended from elongate horizontally oriented support hooks and the like. More particularly, the invention relates to such tags which may be readily attached to and removed from the support hooks without being subject to inadvertent removal, and which display product information forwardly of merchandise suported on a hook.

My prior applications noted above disclose, inter alia, elongate product information and identification tags made of plastic sheet which display the product information forwardly of items suspended from horizontal hooks which may extend, for example, from an apertured support board or the like. The tags include a mounting portion for attachment to and removal from the hook at a location adjacent the board, an intermediate portion extending forwardly from the mounting portion along the length of the hook and the merchandise suspended therefrom, and a display portion integrally formed at the distal end of the intermediate portion and which is bent downwardly in front of the hook for the display of required product identification and/or information data. Further, the tags disclosed in application Ser. No. 06/519,226 have an aperture adjacent the distal end of the intermediate portion for an end portion of the hook to project upwardly through, thereby providing lateral stabilization of the tag. When a product is removed from the hook over the front end, the tag flexes upwardly to free the end of the hook, and the tag drops back over the end of the hook after the product has been removed.

The present invention provides a product identification tag generally of the type disclosed in connection with the above-identified applications, but which has a mounting portion specially developed for use in connection with a particular form of hook and mounting panel known commercially as a Uniweb hook and panel of the type in which the panel has a plurality of horizontally extending vertically spaced projecting hook-mounting channels, and the hook is carried on a bracket having an upper portion of inverted U-shape in profile for fitting over one of the channels and a lower planar stabilization portion for fitting in the channel immediately below.

SUMMARY OF THE INVENTION

A product identification tag in accordance with the invention for use with a hook and mounting panel of the type described comprises a length of sheet material, such as plastic sheet, formed with a mounting portion for anchoring the tag in back of the hook, and at least an elongate intermediate portion extending from the mounting portion for overlying the hook, the mounting portion comprising plural tag panels for forming into a wedge which can be inserted in one of the channels of the support panel behind the upper inverted U-shaped portion of the hook bracket, with a forward one of the panels defining the wedge including a lateral slit against a lower edge of which a free edge of the U-shaped portion of the bracket can be brought into engagement, responsive to insertion of the wedge as aforesaid followed by raising and lowering of the hook bracket, whereby engagement of the respective edges locks the wedge in place in said one channel substantially preventing withdrawal of the tag from the channel until the hook is removed.

Product identification tags in accordance with the invention may include an integral display portion at the forward edge of the intermediate portion for folding down in front of the hook to receive a product information and/or identification label, or the intermediate portion may terminate in attachment means for a separate display portion as disclosed, for example, in my co-pending patent application entitled "Improvements Relating To Product Identification Tags" filed concurrently herewith, and the contents of which is expressly incorporated herein by reference.

BRIEF DESCRIPTION OF DRAWINGS

FIG. 5 is a side elevational view of the tag in combination with the hook and panel shown in FIG. 1; and FIG. 6 is a perspective view of the combination shown in FIG. 5 but with the panel shown in phantom.

DESCRIPTION OF PREFERRED EMBODIMENTS

Figure 1:
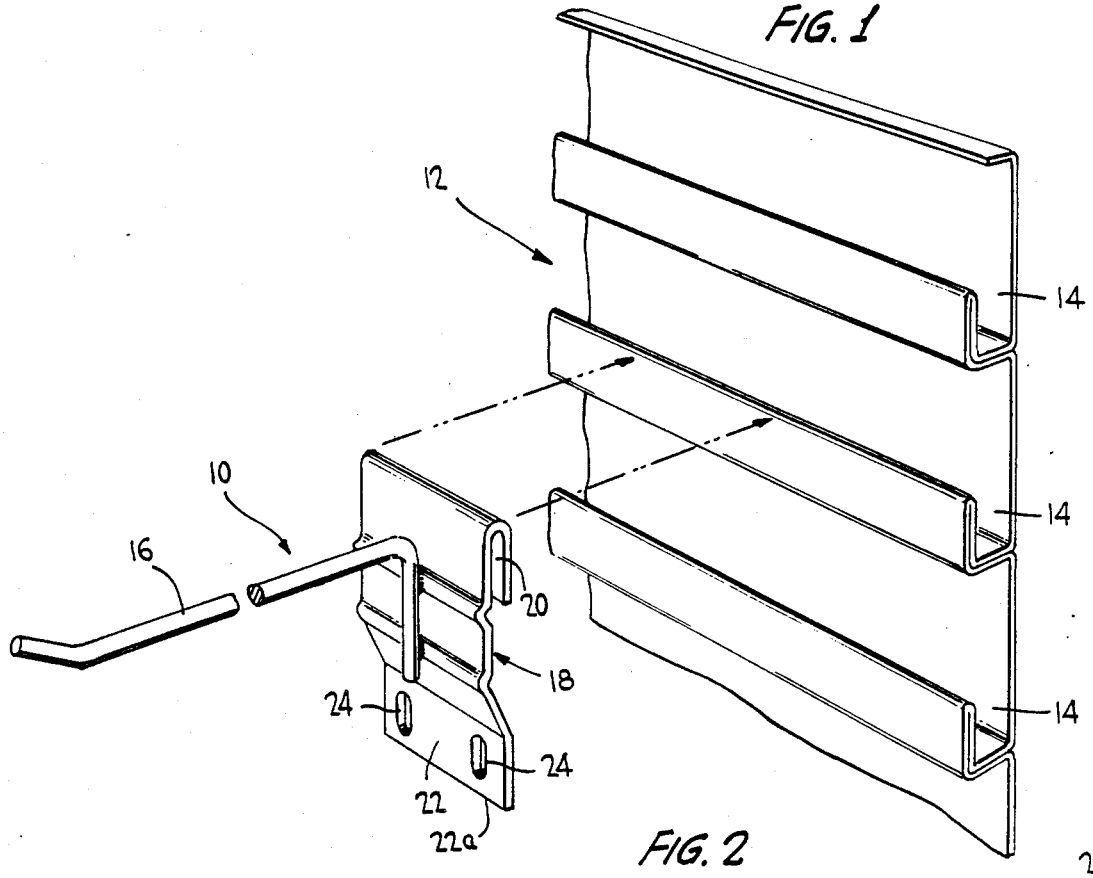
FIG. 1 is a perspective view of a hook and mounting panel with which product identification tags in accordance with the invention are intended for use.
Figure 2:
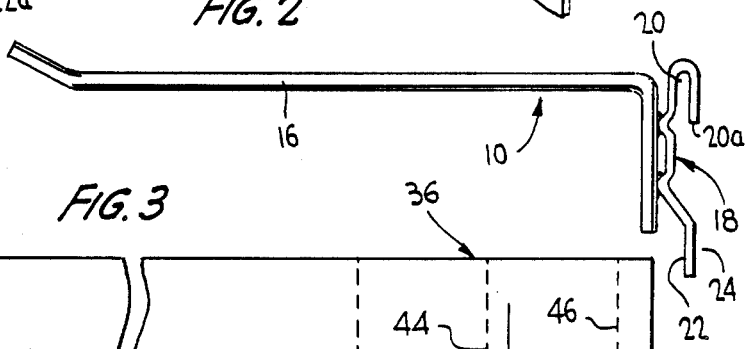
FIG. 2 is a side elevational view of the hook.

Referring to FIGS. 1 and 2, there is shown a particular type of product-display hook 10 and panel 12 on which it may be supported, known commercially as a Uniweb hook and panel. Panel 12 may be formed from metal sheet bent to provide a plurality of superposed projecting channels 14 for receipt of the hook. Hook 10 comprises an elongate rod 16 bent down at the back and there welded to a bracket 18 for releasably attaching the hook to panel 12. The bracket has an upper portion 20 in the shape of an inverted U for hooking over the outer web of one of the channels of panel 12, and a lower portion 22 formed as a stabilizing tongue with projections 24 for fitting in the channel below, as shown in FIGS. 5 and 6. With hook 10 attached to panel 12 in this manner, merchandise articles for display may be suspended from rod 16.

Figure 3:
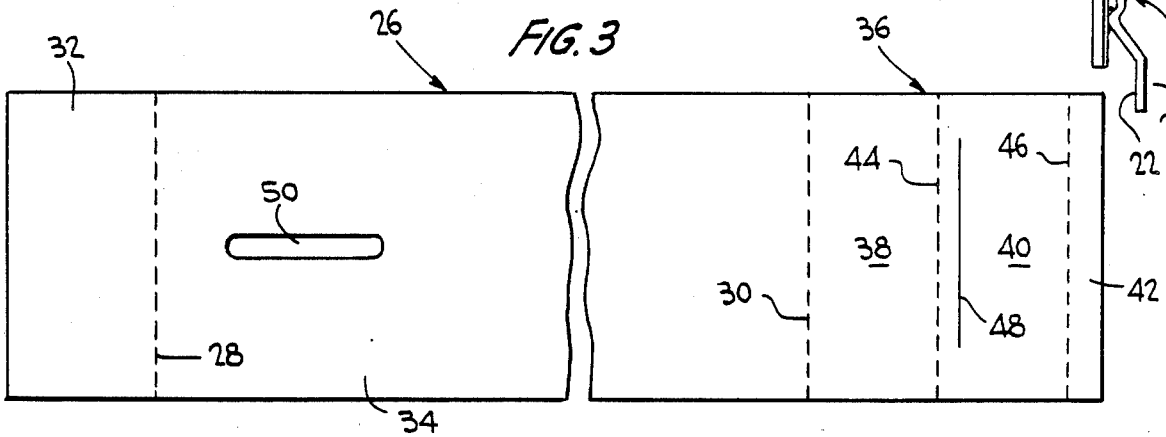
FIG. 3 is a plan view of a blank for forming into a product identification tag in accordance with the invention.

In accordance with the invention, a product identification and information tag, to be described, is provided for use in conjunction with hook 10 for displaying information and/or identification data concerning the merchandise articles at a location forwardly of rod 16. The tag is formed from an elongate blank 26 of plastic sheet shown in FIG. 3.

Figure 4:
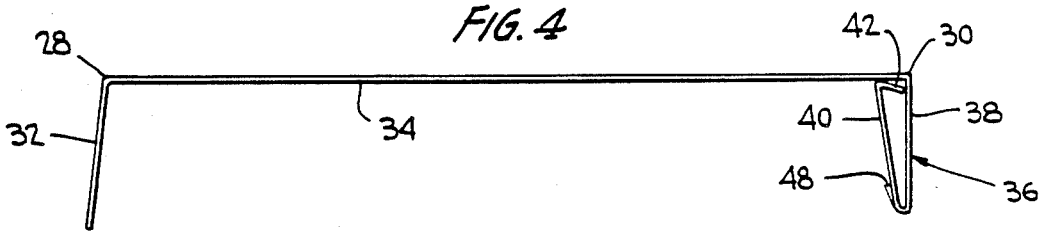
FIG. 4 is a side elevational view of the blank formed into a tag.

Blank 26 has bend lines 28, 30 right across the blank dividing it into a forward display portion 32, an elongate intermediate portion 34, and a rearward mounting portion 36. Further, mounting portion 36 is itself divided into panels 38, 40, 42 by similar bend lines 44, 46. In use, the blank is folded at the respective bend lines, as shown in FIG. 4, so that display portion 32 extends downwardly at the front of the tag and so that the mounting portion is formed into an upright wedge with panel 40 at the front and panel 38 at the back. Further, panel 38 is formed with a die-cut slit 48 extending part way across the panel adjacent bend line 44.

To mount a tag on hook 10, the wedge shaped mounting portion is pressed from above into a channel 14 containing the upper portion 20 of bracket 18 between the bracket and the back of the channel. Then, the bracket is raised slightly and allowed to fall so as to cause the bottom edge 20*a* of portion 20 of the bracket to engage against the lower edge of slit 48 as shown in FIGS. 5 and 6. This effectively traps and stabilizes the mounting portion of the tag in the channel preventing it from being removed until hook 10 is removed.

The intermediate portion 34 of the tag may be provided with a die-cut aperture 50 to fit over the forward end of rod 16 as shown in FIG. 5, to stabilize the tag laterally when, for example, a bar code on a label (not shown) adhered to display portion 32 is being read by a code reader and as fully described in application Ser. No. 519,226.

While display portion 32 has been illustrated and described as being formed integrally with intermediate portion 34, the display portion could alternatively be a separate item for releasable attachment to the remainder of the tag as fully described in the co-pending application noted above which is being filed concurrently herewith.

While only preferred embodiments of the invention have been described herein in detail, the invention is not limited thereby and modifications may be made within the scope of the attached claims.

I claim:

1. A product identification tag for use with an elongate hook extending substantially horizontally from a mounting panel, the panel being of the type having a horizontally extending channel in which a bracket forming the back of the hook engages by means of a portion of the bracket which is in the form of an inverted U fitting over a front web of the channel, the tag comprising a mounting portion for anchoring in the channel behind said portion of the bracket, and at least an elongate portion of sheet material extending from the mounting portion for overlying the hook, the mounting portion comprising a wedge to be inserted in said channel behind said portion of the bracket as aforesaid, a forward surface of the wedge including means defining a lateral projection against which a free lower edge of said portion of the bracket can be brought into engagement responsive to insertion of the wedge as aforesaid followed by raising and lowering of the bracket, whereby engagement of said edge against said projection traps the wedge in place in the channel substantially preventing withdrawal of the wedge from the channel until the bracket is removed.

2. The invention of claim 1 wherein the wedge is formed from plural folded panels of sheet material extending rearwardly from the elongate portion.

3. The invention of claim 2 wherein the lateral projection is defined by one edge of a slit formed in a forward one of the panels.

4. The invention of claim 1 wherein the tag includes an integrally formed display portion extending from a forward end of the intermediate portion.

5. The invention of claim 1 including an aperture in the intermediate portion for receipt of a forward end of the hook.

* * * * *